United States Patent [19]

Geiszler et al.

[11] 4,064,499

[45] Dec. 20, 1977

[54] INTRUSION WARNING SYSTEM UTILIZING AN ELECTRIC FIELD

[75] Inventors: Theodore D. Geiszler, Los Gatos; Ronald W. Mongeon, San Jose, both of Calif.

[73] Assignee: Stellar Systems, Inc., Santa Clara, Calif.

[21] Appl. No.: 612,918

[22] Filed: Sept. 12, 1975

[51] Int. Cl.[2] ..... G08B 13/24

[52] U.S. Cl. ..... 340/258 C; 340/276; 340/409

[58] Field of Search ..... 340/258 C, 276, 409, 340/416

[56] References Cited

U.S. PATENT DOCUMENTS

| | | | |
|---|---|---|---|
| 2,922,147 | 1/1960 | Bredesen | 340/409 |
| 2,956,269 | 10/1960 | Schmidt | 340/258 C |
| 3,047,849 | 7/1962 | Hansen | 340/258 C |
| 3,135,951 | 6/1964 | Byrne | 340/409 |
| 3,237,105 | 2/1966 | Kalmus | 340/258 C |
| 3,778,807 | 12/1973 | Ralston | 340/258 C |

*Primary Examiner*—Glen R. Swann, III
*Attorney, Agent, or Firm*—Spencer & Kaye

[57] ABSTRACT

A quasi-stationary electric field is produced by means of an oscillator whose output is connected to a field wire which is positioned within the area to be protected and the electric field is detected by an antenna whose output is connected to an amplifier. An AM detector is connected to the output of the amplifier and the output of the AM detector is connected via a lowpass filter to a high gain amplifying means including a bandpass filter arrangement so that at the output of this high gain amplifier only signals within the relatively low frequency range associated with movement of an intruder are present. The output signal from the high gain amplifier is fed to a threshold circuit which produces an output signal whenever the input signal thereto exceeds a predetermined threshold value, and this output signal is fed to an alarm producing circuit. The frequency of the electric field is in the range from about 1 to 40KHz and is approximately midway between two successive harmonics of the frequency of the a.c. power existing in the vicinity of the area to be protected in order to decrease the possibility of false alarms. Additionally other techniques for reducing the possibility of false alarms and for extending the utility of such a system are disclosed.

28 Claims, 12 Drawing Figures

INTRUSION WARNING SYSTEM UTILIZING AN ELECTRIC FIELD

BACKGROUND OF THE INVENTION

The present invention relates to an intrusion warning or alarm system for indicating the presence of an intruder within a given area. More particularly, the present invention relates to an improved intrusion warning system of the type wherein the presence of an intruder within a given area is detected by determining the changes caused by the intruder in an electric field in the area to be protected.

Various types of intrusion warning systems which operate on the principle of detecting a change in an electric field caused by the intruder are known in the art. Generally such systems utilize a high impedance sensing device, for example, an antenna, which is placed within the area to be protected and monitors the electric field within the area, which electric field may be either the inherently present electric field or an electric field specifically produced by the antenna or sensing device. Any change in the charge on the antenna due to the electric field being disturbed by the intruder is then detected and converted to an electrical signal which is used to provide an indication.

One type of intrusion warning or detection system which also responds to changes in electrical fields caused by an intruder and which operates in a different manner than that mentioned above, is disclosed in U.S. Pat. No. 3,237,105, issued Feb. 22, 1966 to Henry P. Kalmus, the subject matter of which is incorporated herein by reference. According to the teachings of this patent, a transmitting electrode and a receiving electrode are positioned on opposite sides of the area to be protected, e.g., a doorway, and a quasi-stationary electric field is produced within the area to be protected by connecting an oscillator to the transmitting electrode which oscillates at a frequency in the range of, for example, 5 to 100kHz. The receiving electrode is connected by an amplifier to an AM detector which detects the modulation of the received field signal caused by the movement of an intruder between the two electrodes, and the detected signal is fed to an amplifier including a bandpass filter with a bandpass in the order of 2 to 20Hz, thereby passing the low frequency component due to movement of an intruder in the area between the electrodes. This filtered signal is then fed to an indicating or alarm device to indicate the presence of an intruder.

Although the system disclosed in this patent operates satisfactorily in principle, the system is susceptible to a number of problems when attempts are made to utilize same in practical applications or to extend the range of the system so that it can be utilized to cover relatively large areas, thus necessitating that the sensitivity, and hence the gain, of the system be increased. One primary problem in practical applications of such systems is that of false alarms caused by stray electric fields in the area to be protected, or by transients. One primary source of stray electric fields normally present is the electric fields radiated by a.c. power lines or building wiring which would normally be present in the vicinity of an area to be protected by such an intrusion warning system. For example, while the primary a.c. power frequency, e.g., 60 Hz, would be outside of the passband of the system, the numerous devices and appliances normally operating from the power line cause extremely rapid current changes on the line, and these in turn cause energy to be created at multiples or harmonics of the power line frequency. If one of these harmonics should be equal to the frequency of the generated electric field or sufficiently close thereto to cause a beat frequency signal to be produced which is within the passband of the detection system, then a false alarm could result. Similarly, other transients creating signals within the passbands of the system could result in false alarms.

SUMMARY OF THE INVENTION

It is therefore a primary object of the present invention to provide and improve the intrusion warning system of the above-identified type whereby the susceptibility to false alarms is materially reduced.

It is a further object of the present invention to provide an improved intrusion warning system of the above-identified type having a greater versatility with regard to its application, e.g., for the detection of an intruder anywhere within an enclosed area such as a room or to provide perimeter protection for a large area such as a building.

According to the basic concept of the invention, the intrusion warning system comprises a quasi-stationary electric field producing means including a field wire located within the area to be protected and an oscillator circuit connected to the field wire for producing an output signal having a wavelength which is very long compared to the length of the field wire and a frequency which is in the range of from 1 to 40 KHz and is approximately midway between two successive harmonics of the frequency of the a.c. power existing in the vicinity of the area to be protected; an antenna within the area to be protected for receiving the electric field signal; an amplifier having its input connected to the output of the antenna and its output connected to an AM detector; a lowpass filter connected to the output of the detector for filtering out signals above approximately 20Hz; a high gain bandpass amplifier connected to the output of the lowpass filter for amplifying and passing only the low frequency component of the detected signal due to movement of an intruder in the area to be protected; a threshold circuit connected to the output of the bandpass amplifier for producing an output signal whenever it receives an input signal exceeding a predetermined threshold value; and an alarm circuit for providing an alarm indicating the presence of an intruder within the area being protected.

According to further features of the invention, the susceptibility of the system to false alarms is further reduced by either locking the frequency of the oscillator to that of the power line frequency or disabling the alarm circuit whenever a harmonic of the power line frequency is sufficiently close to the frequency of the oscillator to produce a beat frequency signal within or very close to the bandpass of the system; by utilizing a synchronous detector for the AM detector; and/or by providing a circuit arrangement, e.g., a ramp voltage circuit, which prevents the threshold circuit from responding to random or transient events.

According to still further features of the invention, the receiving antennas may take various shapes and configurations and may be remotely located from the input amplifier.

DETAILED DESCRIPTION OF THE PREFERRED EMBODIMENTS

Figure 1:
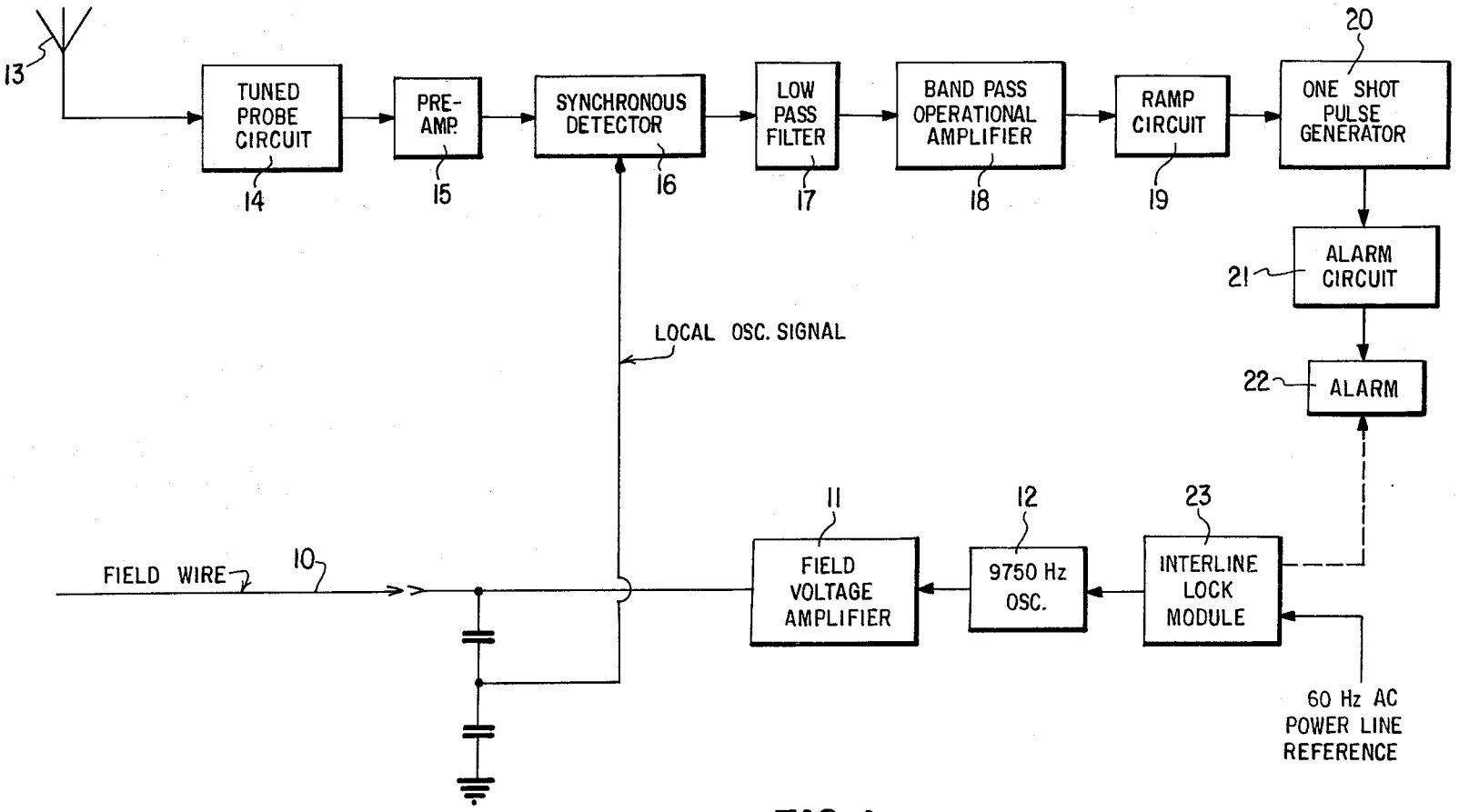
FIG. 1 is a block circuit diagram of a preferred embodiment of the intrusion warning system according to the invention.

Referring now to FIG. 1, in the intrusion warning or alarm system according to the invention, in order to produce a desired alternating electric field within an area to be protected, a transmitting antenna or field wire 10 is positioned at a desired location within an area to be protected, and is connected via an amplifier 11 to the output of a local oscillator 12 which produces a low frequency output signal whose wavelength is very long compared to the length of the field wire 10. The frequency of the oscillator 12 is, for example, in the range of from 1 to 40KHz, and preferably in the range of from 2 to 20KHz.

In order to detect the electric field, a receiving antenna 13, which may for example be a length of wire or a conductive plate, is connected to an input of a tuned probe circuit 14 which includes a resonant circuit tuned to the frequency of the oscillator 12. The output of the tuned probe circuit 14 is connected to the input of an amplifier 15, which preferably provides bandpass shaping for the frequency of the oscillator 12, and contains sufficient gain to properly drive the AM detector 16 connected to the output of the amplifier 15. The AM detector 16 may, for example, be a simple diode detector. Preferably, as shown and as will be discussed further below, the AM detector 16 is a synchronous detector.

The output signal from the AM detector 16 is passed via a lowpass filter 17 having a cutoff frequency so that it will at least filter out signals above about 20Hz, to the input of a high gain operational amplifier 18 which is provided with a bandpass filtering arrangement so that the overall bandpass is in the order of about 0.2 to 2Hz, which range constitutes the low frequency component associated with the motion of an intruder and is the frequency component of interest. The filtered and amplified output signal of the operational amplifier 18 is then fed via a ramp voltage generating circuit 19, which will be discussed in detail below, to the input of a pulse generator 20 which produces an output pulse whenever the input signal thereto exceeds a predetermined threshold value. The output pulse from the pulse generator 20 is, as is conventional in intrusion warning systems, fed to the alarm or indicating control circuit 21 which in turn energizes the alarm 22.

In the basic mode of operation of the system, the motion of an intruder within the electric field produced by the field wire 10 will result in a modulation of the amplitude of the electric field signal received by the antenna 13 causing the signal at the output of the AM detector to vary, and result in the generation of an alarm.

As mentioned above, one primary source of false alarm in a system of the above-identified type is the electric field produced by the radiation of the a.c. power line harmonics from the wiring or power lines present in the vicinity of the area to be protected. In order to reduce the probability of false alarms from this source, according to the invention the frequency of the oscillator 12 is selected so that it is a nonwhole number multiple or harmonic of the power line frequency and falls approximately between two successive harmonics of the a.c. power line frequency. For example, the frequency of the oscillator 12 may be selected to be 9750Hz as illustrated which is 162.5 times the conventional 60Hz power line frequency. Thus the frequency of the oscillator 12, and hence that of the generated electric field would be clear of any whole number harmonic of the power line frequency and moreover would generally not result in any beat frequencies with the harmonics of the power line frequency which would be within the bandpass of the signal detecting system, and in particular the amplifier 18.

Although operating the oscillator 12 at a frequency which is related to the power line frequency in the manner described above results in a reduction in the probability of false alarms, this measure by itself would still not substantially eliminate this source of error since, as is well known, the power line frequency changes due to load changes and due to intentional frequency corrections made by the power company to correct electric clocks. Therefore, in order to further reduce the probability of false alarms due to this source of error, as shown in FIG. 1 the system is provided with an interline lock module 23 which is connected to the oscillator 12 and its primary purpose is to reduce the false alarms due to power line harmonics.

Figure 2:
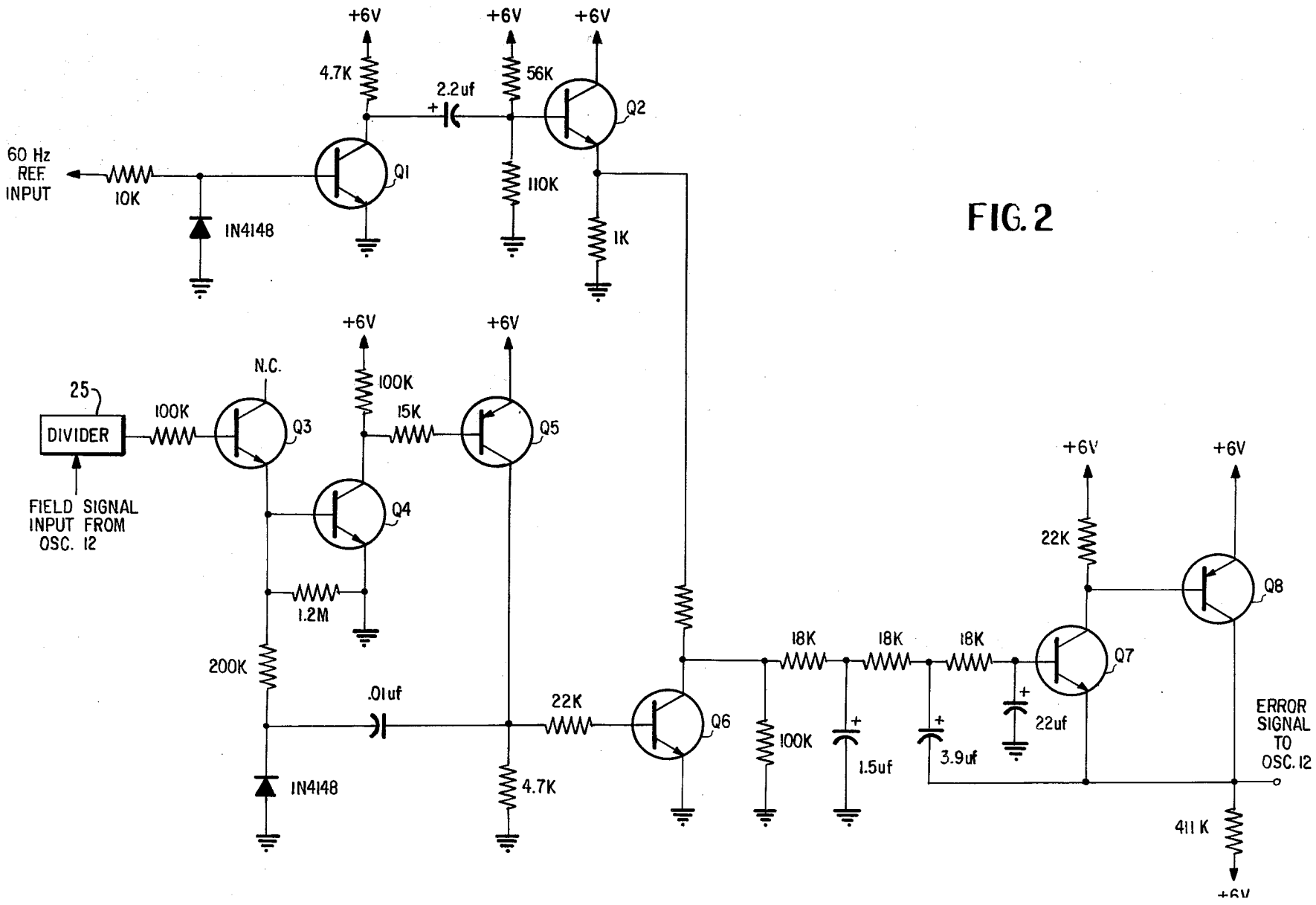
FIG. 2 is a circuit diagram of one embodiment of an interline lock module for use in the system of FIG. 1.

One embodiment of such an interline lock module is shown in FIG. 2 and serves the purpose of locking the frequency of the oscillator 12 to the power line frequency. As shown in this figure, the output signal from the oscillator 12, which in the illustrated example is normally at a frequency of 9750Hz, is fed to a divider 25 which divides the frequency of the oscillator 12 down to the power line frequency, i.e., 60Hz. In the illustrated embodiment, this means that the divider 25 must produce an overall division by 162.5 which can be realized in a known manner by, for example, multiplying by 2 and then dividing by 325. Since, the nature of such a fractional division process does not yield a squarewave output, but rather a pulse train, this pulse train is then processed through a circuit including transistors Q3, Q4 and Q5 which serve as a one shot pulse generator to yield an approximately squarewave output at 60Hz. The 60Hz a.c. power line frequency signal is converted to a squarewave by means of the circuit containing transistors Q1 and Q2 and the output of transistor Q2 is combined with the output of transistor Q5 in a transistor Q6 which operates as a phase comparator. The output of transistor Q6 therefore contains a d.c. voltage component which depends upon the phase relationship between the two signals fed to the transistor Q6. The output voltage from transistor Q6 is then passed through an active lowpass filter including transistors Q7 and Q8 and the associated components to produce a d.c. error voltage which is fed to the oscillator 12 in a known manner to control the frequency and thus keep it phase locked to the a.c. power line frequency. Thus, false alarms resulting from low frequency beat note interference from harmonics of the a.c. power line frequency are avoided.

While the above-described embodiment of the interline lock module provides a practical solution to the problem in question, this solution does have one undesirable feature. That is, the locking of the frequency of oscillator 12 to the power line frequency results in the operating frequency for the intrusion warning system continuously changing. This means that the tuned circuits in the intrusion warning system must be broad enough to tolerate these frequency changes without resulting in false alarms caused by changes in signal amplitudes within the intrusion system circuitry. Accordingly to avoid this drawback, a further embodiment of an interline lock module suitable for use in the system of FIG. 1 is shown in FIG. 3.

Figure 3:
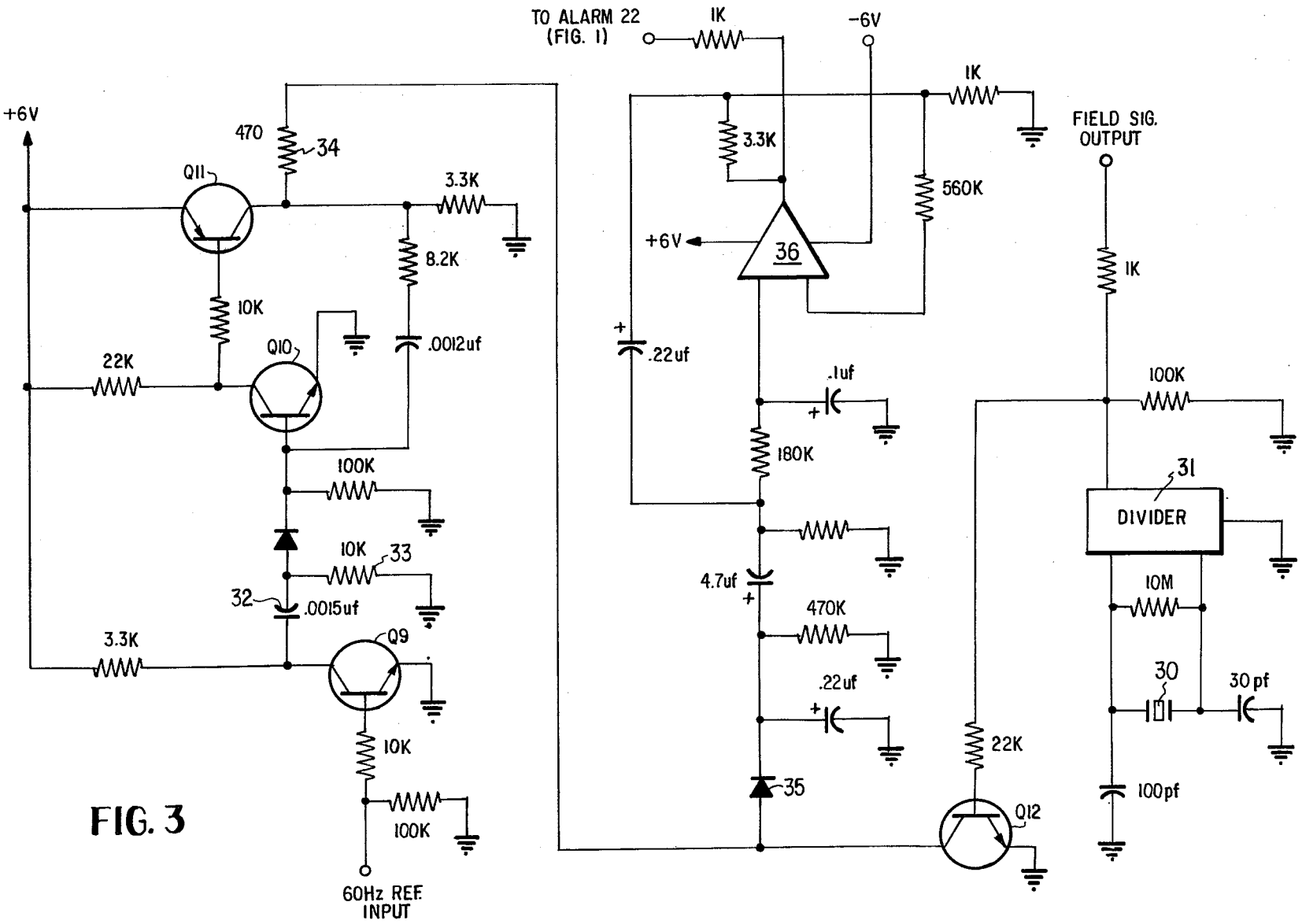
FIG. 3 is a circuit diagram of a further embodiment of an interline lock module for use in the system of FIG. 1.

In the arrangement of FIG. 3, the frequency of the oscillator 12 is not locked to the frequency of the a.c. power line, but rather the oscillator 12 is permitted to operate at a closely controlled fixed frequency. As shown in FIG. 3, the oscillator is a crystal controlled oscillator again operating at, for example, 9750Hz which is between the 162nd and 163rd harmonic of the 60Hz power line frequency. As shown in the drawing, the oscillator 12 includes a crystal 30 with its associated components and a divider 31 at whose output the desired frequency of 9750Hz appears. The divider stage 31 permits an inexpensive quartz crystal operating at 2.496MHz to provide the desired output frequency. Since the output frequency from the oscillator 12 is closely controlled, no interference of false alarm problem exists unless the power line frequency changes slightly, thus producing a harmonic at or very near the operating frequency, i.e., 9750Hz. Such an interference frequency or harmonic will of course take place in a practical application because the power line frequency of 60Hz would only have to change by 0.185Hz for its 162nd or 163rd harmonic to appear at 9750Hz.

The interline lock module arrangement of FIG. 3 prevents false alarms caused by such harmonics in that it continuously monitors the beat or difference frequency between the power line harmonics and the output signal from the divider 31 and disables the alarm as long as this beat frequency falls below a predetermined frequency. This functioning of the interline module of FIG. 3 is accomplished in that the 60Hz a.c. power line signal is fed to a transistor Q9 wherein the signal is limited and squared and then the output of transistor Q9 is differentiated by capacitor 32 and the resistor 33 to form trigger pulses which are fed to the input and trigger a 50 microsecond one-shot pulse generator formed by the transistors Q10 and Q11 with their associated components. The train of 50 microsecond pulses appearing at the output of transistor Q11 is fed through a resistor 34 and gated on and off by a transistor Q12 which is controlled by the output signal from the divider 31, i.e., the 9750Hz operating frequency signal. This gated train of pulses is then demodulated by a diode detector 35 so that the signal appearing at the output of diode 35 contains frequency components of interest which are the best frequencies between the output signal from divider 31 and the 162nd and 163rd harmonics of the 50 microsecond 60Hz pulse train appearing at the output of the transistor Q11. When the a.c. power line frequency is exactly 60Hz, the 162nd and 163rd harmonics would be at 9720Hz and 9780Hz respectively, and the intruder warning system operating frequency will lie midway between them at 9750Hz, resulting in a beat frequency difference of 30Hz which is outside the passband of the field detecting circuitry, and in particular the operational amplifier 18, and hence no false alarm will be produced. However, if the power line should change frequency slightly so that one of its harmonics comes too close to the operating frequency of 9750Hz, for example, within 3Hz, a false alarm could be triggered. In order to prevent such a false alarm, and to provide an additional margin of safety, the output signal from the diode detector 35 is fed to an active lowpass filter, including the operational amplifier 36 and its associated components which passes beat frequencies below 6Hz to inhibit the alarm whenever a beat frequency below 6Hz, a value which is slightly larger than the bandpass of the signal detecting circuitry, is present.

Figure 4:
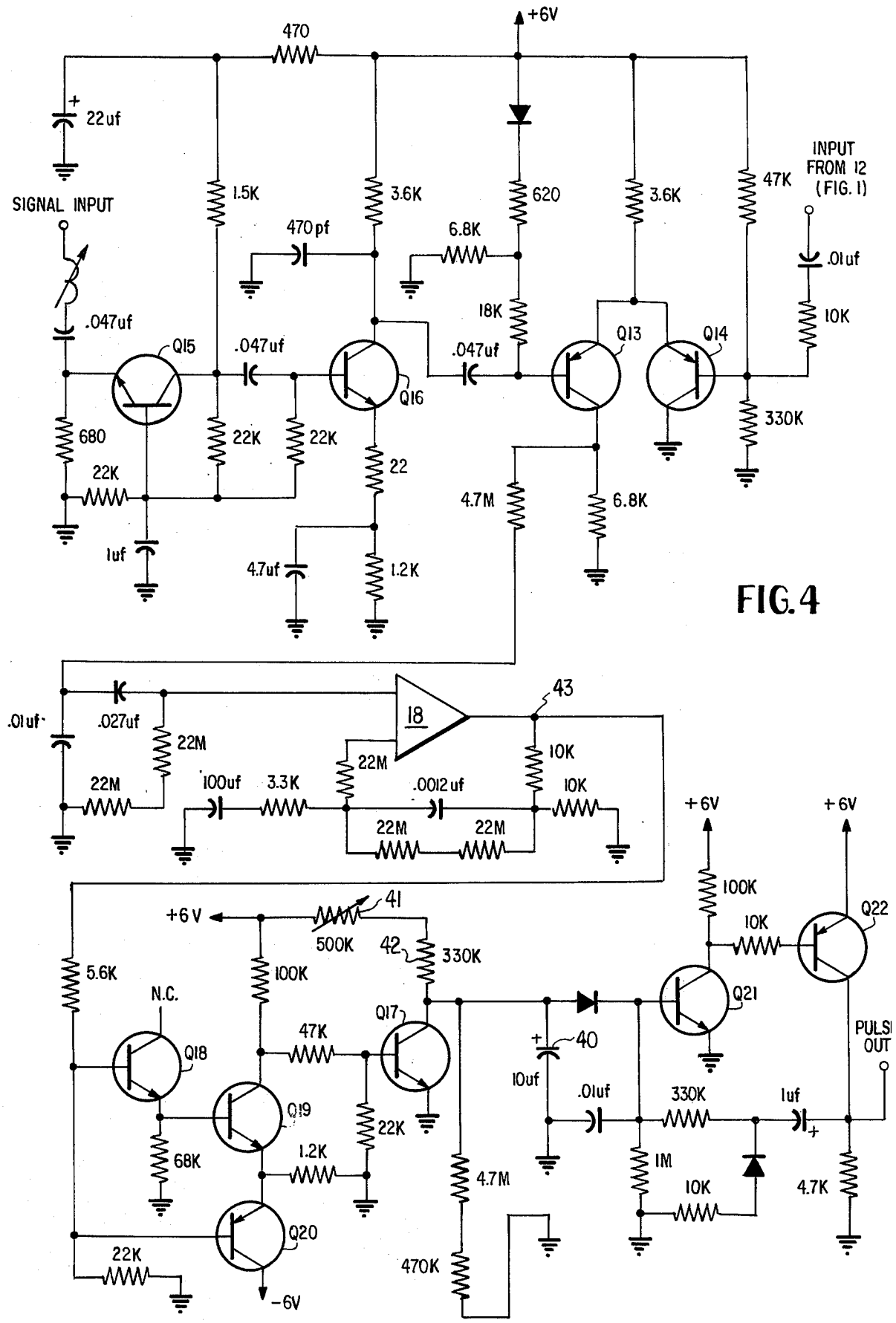
FIG. 4 is a circuit diagram of a preferred embodiment of the signal detecting circuitry for the intrusion warning system of FIG. 1.

While it was pointed out with regard to FIG. 1, the AM detector 16 could be a simple diode detector, the use of such a detector could result in a false alarm if an extraneous nearby signal of sufficient magnitude is detected, even if this extraneous signal has a frequency which is outside the passband of the detection circuitry. In order to provide false alarm immunity from such signals, as further indicated with regard to FIG. 1, the detector 16 is preferably a synchronous detector to whose other input is fed the output signal from the oscillator 12 so that the detector is switched on and off synchronously with the received signal appearing at the output of the preamplifier 15. The circuit diagram for the synchronous detector is shown in FIG. 4 and includes the transistors Q13 and Q14 and the associated components. The output of the oscillator 12 is connected to the base of the transistor Q14 while the output signal from the preamplifier 15, which is shown in FIG. 4 by transistors Q15 and Q16 and their associated components, is connected to the base of transistor Q13.

With this arrangement, if a signal appears at the base of Q13, it will, depending upon its phase, linearly add to or substract from the square waveform produced at the collector of transistor Q13 by the switching on and off of the transistor Q14 by the output signal from the oscillator 12. If the signal applied to the base of transistor Q13 is of a different frequency than the signal from oscillator 12, the collector of Q13 will contain the beat frequency difference which will vary the output from the synchronous detector between plus and minus when there is no input signal to the transistor Q13, thus producing negligible change in the average d.c. output of the synchronous detector appearing at the collector of transistor Q13. This will then result in no false alarm being produced due to such an extraneous interfering signal.

Alternatively, the desired signal, which is coherent with the signal from the oscillator 12 appears as a fixed change in the average d.c. level at the collector of transistor Q13. Consequently, any motion of an intruder within the area being protected by the system according to the invention will cause the received signal amplitude to change, and consequently the d.c. level at the collector of transistor Q13 to change and be recognized by the succeeding circuitry as an intruder produced signal.

It should be noted that the incorporation of a synchronous detector in the intrusion warning system according to the invention requires that the received signal applied to the base of transistor Q13 be properly phased with respect to the oscillator signal applied to the base of Q14 because a synchronous detector is inherently a phase sensitive device and produces no output when its inputs are 90° out of phase. Since the intrusion warning system according to the invention operates on the principle of radiating an electric field from a field wire and receiving this signal by means of a receiving antenna spaced from the field wire, there inherently is a 90° phase shift resulting from the coupling of the signal from the field wire 10 to the receiving antenna 13 through space. This 90° phase shift must therefore be compensated in order for the synchronous detector to operate at maximum efficiency. While the compensation for this 90° phase shift may be provided by shifting the phase of the output signal from the oscillator 12 by 90° prior to applying same to the synchronous detector, according to a further feature of the present invention, the 90° phase shift is incorporated in the tuned probe circuit which will be discussed below.

As indicated above with respect to FIG. 1, in order to eliminate false alarms caused by short term transient responses, the intrusion warning system according to the invention is provided with a novel ramp voltage generating circuit 19 whose output voltage does not reach the threshold value required to cause the pulse generator 20 to produce an output pulse until the amplifier 18 produces an output signal indicating sustained motion of an intruder in a single given direction for a predetermined period of time. The use of such a ramp signal is based on the realization that in an electric field type of intrusion warning system as in the present invention, the amplifier 18 will produce a sustained d.c. signal of a single polarity for as long as the intruder continues to move in a given direction. Basically, the ramp circuit operates to begin the production of a ramp voltage of a given polarity upon the first detection of a signal at the output of the amplifier 18. This ramp voltage will continue to increase as long as the output signal of the amplifier 18 is of the same polarity. The time required for the ramp to reach the threshold value of the pulse generator 20 is adjusted so that it is sufficiently long to provide a positive indication of sustained motion and is in the order of approximately 0.75 seconds for average use. If at any time during the ramp time, the output signal from the amplifier 18 reverses polarity, the ramp voltage immediately returns to 0, at which point it will begin again upon the presence of an output signal of either polarity from the amplifier 18.

Referring now again to FIG. 4 there is shown the circuit for the ramp voltage generator 19 which generally includes the transistors Q17 to 20 and the charging capacitor 40. The transistor Q17, which has its emitter-collector path connected in parallel with the capacitor 40, basically acts as a switch which controls the charging of the capacitor 40 via the resistors 41 and 42 from the source of d.c. supply voltage, and also the discharging of the capacitor 40. In particular, whenever the transistor Q17 is conducting, any charge voltage on the capacitor 40 will be immediately discharged to ground, thus terminating the ramp voltage produced by the charging of capacitor 40, and further charging of the capacitor 40 will be prevented. Alternatively, whenever the transistor Q17 is in its blocked state, i.e. non-conducting state, the capacitor 40 will be charged by the resistors 41 and 42 to produce the desired ramp voltage. The transistor Q17 is normally biased so that it is in the conducting state whenever there is either no output signal of a given polarity at the output terminal 43 of the band pass operational amplifier 18, or whenever the output signal at the terminal 43 passes through 0. The transistors Q18 to Q20 which are connected between the output terminal 43 of the amplifier 18 and the base of the transistor Q17, are responsive to a signal of either a positive or a negative polarity appearing at the output 43 of the amplifier 18 to switch the transistor Q17 to its non-conducting state, thus permitting the capacitor 40 to be charged to produce the desired ramp voltage. If the output signal at the terminal 43 maintains a given polarity for a sufficient length of time (which may be set by varying the resistance 46 and as indicated above is normally in the order of 0.75 seconds) capacitor 40 will be charged to a value sufficient to cause the pulse generator formed by transistors Q21 and Q22 and their associated components to be triggered and produce an outward pulse which initiates an alarm signal.

Alternatively, if the output signal at terminal 43 is produced by an interference or transient signal having a period which is short with respect to the time required for the capacitor 16 to be charged to the threshold value required to trigger the pulse generator, charging of the capacitor 40 would be initiated whenever the output signal at the terminal 43 is of a positive or a negative polarity but the transitor Q17 would be rendered conductive, thus immediately discharging the capacitor 40 whenever the output signal at terminal 43 passed through 0, and consequently the capacitor 40 would never be charged to the value required to trigger the pulse generator and initiate an alarm. It should be noted that an interference signal of the type mentioned which swings back and forth between positive and negative polarity values with a period shorter than that required for the ramp voltage to reach the desired threshold value is often encountered in practical applications. For example, such a signal could be a beat frequency between the frequency of the electric field generated by the field wire 10 and some other signal or it could, for example, be the result of vibration of the field wire 10 relative to the antenna 13.

The description of the invention thusfar has been directed to features for improving the immunity of the system to false alarms. According to further features of the invention, however, the versatility of the basic intrusion warning system according to the invention is improved by providing configurations for the receiving antenna which are different than the simple wire or rod disclosed in the prior art system and by providing improved signal input circuitry to the amplifier 15 of FIG. 1.

Figure 6:
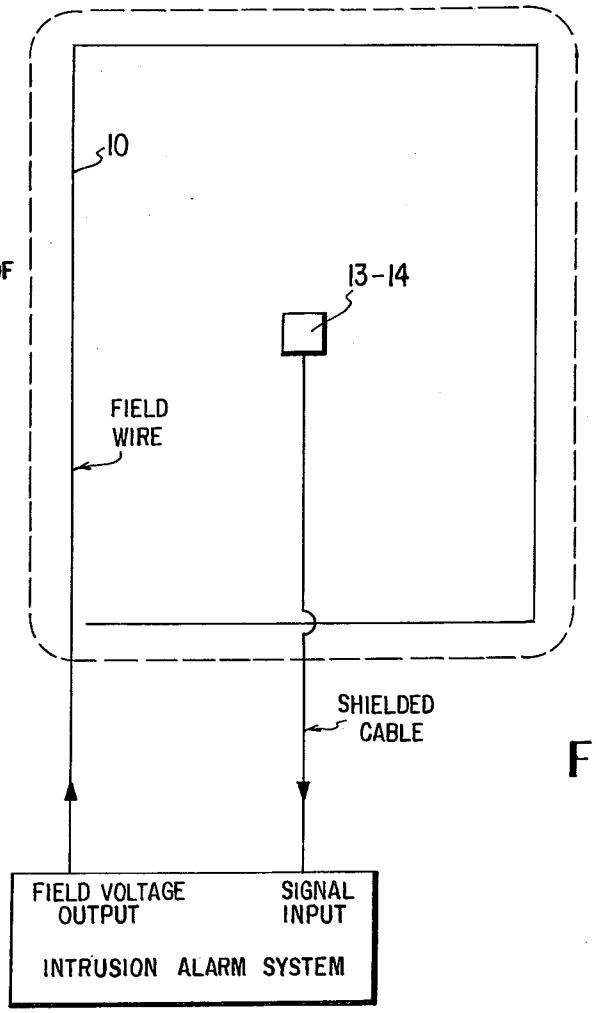
FIG. 6 is a schematic diagram illustrating an application of the antenna and probe circuit arrangement of FIG. 5.
Figure 5:
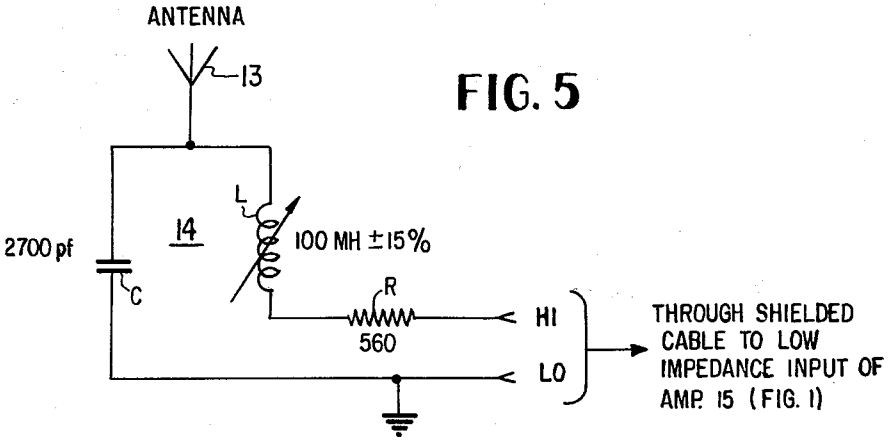
FIG. 5 is a schematic circuit diagram of one embodiment of the receiving antenna and tuned probe circuit according to the invention which is particularly useful for indoor applications.

Referring now to FIG. 5, there is shown one embodiment of an improved antenna and tuned probe circuit arrangement according to the invention which is particularly useful for indoor applications, for example, the protection of a room as shown in FIG. 6. The circuit shown in FIG. 5, consists of a metal box approximately one and a half inches high by about 4 inches square with the box itself serving as the receiving antenna 13 and the remainder of the circuitry shown in FIG. 5 being contained within the metal box. As shown in FIG. 6, such an antenna and probe circuit arrangement may be utilized to provide protection for a room, for example, a room 16 by 20 feet square, by installing the metal box in the attic or under the floor in approximately the center of the room to be protected and by running the field wire 10 substantially around the perimeter of the room, also within the attic or under the floor. As further shown in FIG. 6, the metal box 13–14 is connected to the signal input of the intrusion alarm system, which constitutes the input to the amplifier 15 of FIG. 1, via a length of shielded cable. For reasons, which will become clear from the following discussion of the tuned probe circuit, the amplifier 15 is provided with a low input impedance, which is constituted by the grounded base input stage transistor Q15 of FIG. 4. The probe circuit arrangement of FIG. 5, which is connected to this low impedance input basically comprises a parallel resonant LC circuit, which is tuned to the frequency of the oscillator 12 and which has a series resistance connected in its inductive branch. The value of the resistance is chosen to yield the desired Q for the tuned circuit, with Q values in the order of 10 to 20 being preferred. Additionally, the impedance of the tuned probe circuit is high relative to the impedance which it sees looking into the end of the shielded cable, which in turn is matched to the relatively low input impedance of the amplifier 15, so that relatively long lengths of shielding cable may be utilized whereby the receiving antenna 13 and tuned probe circuit 14 may be remotely located from the amplifier 15, and yet provide sufficient gain to enable proper detection of the signals of interest.

It should further be noted that with the probe and antenna circuit arrangement of FIG. 5, the signal delivered to the input of the transistor Q15 of FIG. 4 is the series signal circulating within the tuned circuit. This technique results in the 90° phase shift required to correct for the inherent 90° phase shift which takes place between the field wire 10 and the antenna 13 due to their capacitive coupling through space, and thus permits proper operation of the synchronous detector 16. Moreover, as a result of the low input impedance of the amplifier 15, and its relationship to the impedance of the shielded cable and the tuned probe circuit, it is possible to connect a plurality of these tuned probe circuits 14 via separate respective lengths of shielded cable to a single input of the amplifier 15, thus permitting the simultaneous monitoring of a plurality of areas.

Figure 7:
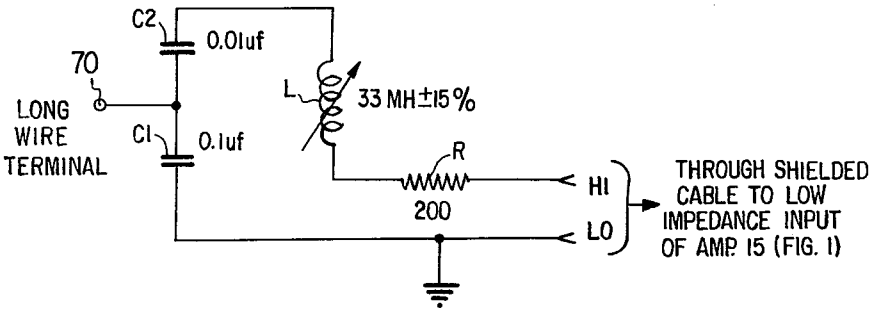
FIG. 7 is a schematic circuit diagram illustrating another embodiment of an antenna and probe circuit arrangement according to the invention which is particularly useful for outdoor applications.

FIG. 7 shows a modification of the antenna and tuned probe circuit arrangement of FIG. 5 which is particularly useful for outdoor applications wherein perimeter protection is desired. The circuit shown in this figure is essentially the same as that shown in FIG. 5 with the exception that the antenna is not constituted by the metal box containing the tuned probe circuit, but rather is provided by a long length of wire which is connected to a terminal 70. In applications where such a long wire receiving antenna is utilized, it is placed parallel to the field wire 10 along a considerable length thereof. One such application is shown for example in FIG. 8. As a result of the close coupling between the field and antenna wires in this embodiment, the signal received by the antenna wire is considerably greater in amplitude than would be received by antenna such as shown in FIG. 5, and accordingly the amplitude of the received signal is tapped down in the tuned circuit by means of the divider formed by the two series connected capacitors C1 and C2. Other than this difference, the circuit shown in FIGS. 4 and 5 are essentially the same and are connected to the input of the amplifier 15 in the same manner.

Figure 8A:
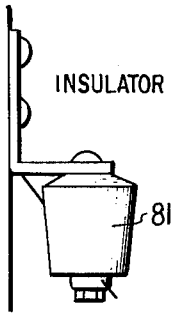
FIGS. 8*a* and 8*b* are enlarged details of the insulator mountings of the system of FIG. 8.
Figure 8:
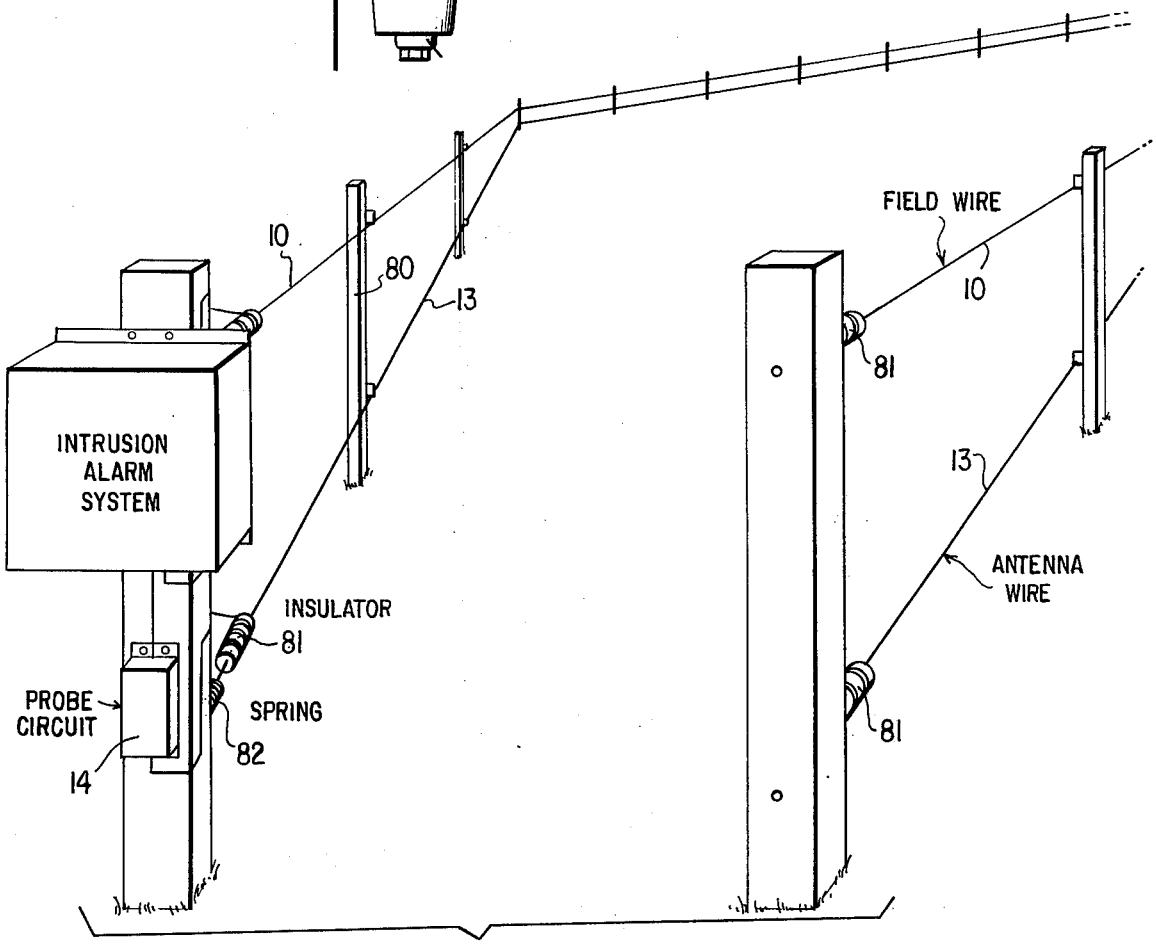
FIG. 8 illustrates the use of the antenna and probe circuit arrangement of FIG. 7 for perimeter protection of an outdoor area.
Figure 8B:
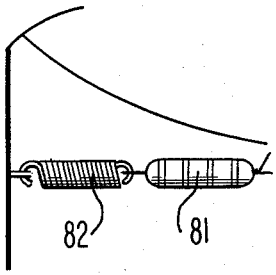

In the application shown in FIG. 8, the protection of the perimeter of field is desired. Accordingly, to provide such a perimeter protection, the field wire is extended around the perimeter of the area to be protected and mounted on fence posts 80, distributed about the perimeter, by means of insulators 81. The field wire 10 in such an application is for example, suspended on the posts approximately five feet from the ground. The antenna wire 13 is mounted on the posts 80 in a similar manner so that it extends around the perimeter parallel to the field wire 10 between the field wire and ground. For example, the antenna wire may be approximately one and a half feet from the ground. With such an installation, anyone approaching within approximately five feet of the fence formed by the field and antenna wires will be detected. It should be noted that with the type of installation shown in FIG. 8 an additional source of false alarm problems is provided in that wind, birds or the like may cause vibration of the field and/or antenna wires. In order to reduce the susceptibility of the system to false alarms from this source, according to a further feature of the invention as shown in FIG. 8, one end of each of the wires is connected to its associated fence posts 80 via a spring 82 which places the associated field or antenna wire under sufficient tension so that any vibration thereof would be at a rate which is outside of the passband of the amplifier 18. This can be accomplished for example, by placing the wires under a tension of approximately 50 pounds with fence posts 80 spaced approximately 25 feet apart.

Finally, in addition to the above-discussed improvements and modifications of the basic prior art system which extends its utility for practical applications, it is desirable and usual in intrusion warning systems to provide some type of supervision for any lines or wires which are utilized for detection purposes to determine if the wires are cut, shorted together or grounded so that the operator will know whether the system is operating properly. With the outdoor "fence" type of perimeter protection arrangement shown in FIG. 8, it would be relatively easy for someone to cut, short or ground the field and/or antenna wires during some period of time when the system is normally not in operation and accordingly some type of supervision arrangement is desirable to detect any such damage whenever the operator places the system in operation. It should be noted that tampering with the wires while the system is in operation is not a problem since such tampering would set off the alarm. A relatively simple circuit arrangement for providing supervision for a fence type arrangement such as shown in FIG. 8 is shown in FIG. 9.

With a fence type arrangement such as shown in FIG. 8 wherein the field wire 10 and the antenna wire 13 extend parallel to one another, passing a current through one wire and then back through the other wire will suffice to indicate if either wire is cut or shorted to ground. Moreover, if a series resistance is connected between the remote ends of the field and antenna wires when the current is passed therethrough, the basic information needed to detect if the two wires are shorted together will be provided. However, merely adding such a resistor across the remote ends of the two wires would interfere with the desired coupling of the electric field between the field and antenna wires, and accordingly a network must be connected between the remote ends of the field and antenna wires which will permit the d.c. monitoring current to perform its supervision function while at the same time prevent the direct coupling of the field voltage from the field wire 10 to the antenna wire 13. As shown in FIG. 9, the desired resistive termination between the remote ends of the field and antenna wires is achieved by providing the termination in the form of two series connected resistors 90 and 91 and by connecting the common junction of the resistors 90 and 91 to ground via a capacitor 92. This arrangement allows a d.c. monitoring current applied to the field wire 10 to flow while at the same time shunting the field voltage to ground via the capacitor 92. Typical values for the resistances 90 and 91 and the capacitor 92 are 1 megohm, 270 kilohms and 0.1 microfarad respectively. Since the resistance values for the resistors 90 and 91 are high, this arrangement does not significantly load or hamper the normal usage of the field and probe wires. In order to complete the supervision arrangement, the d.c. current flowing in the loop formed by the field wire 10, the resistors 90 and 91 and the antenna wire 13 is monitored by a current detecting circuit 93 which produces an output signal to energize the alarm 22 of FIG. 1 if the monitored current falls outside of a normal or predetermined range. The reason for this is that if either the field wire 10 or the antenna wire 13 is cut or shorted to ground the monitored d.c. current will drop, while if the two wires are shorted together the current will increase. Consequently if the monitored current falls outside of the predetermined range either by being too high or too low, this is in an indication that a problem exists and the operator is immediately warned of same when he tries to turn on the system by the fact that the alarm is sounding.

Figure 9:
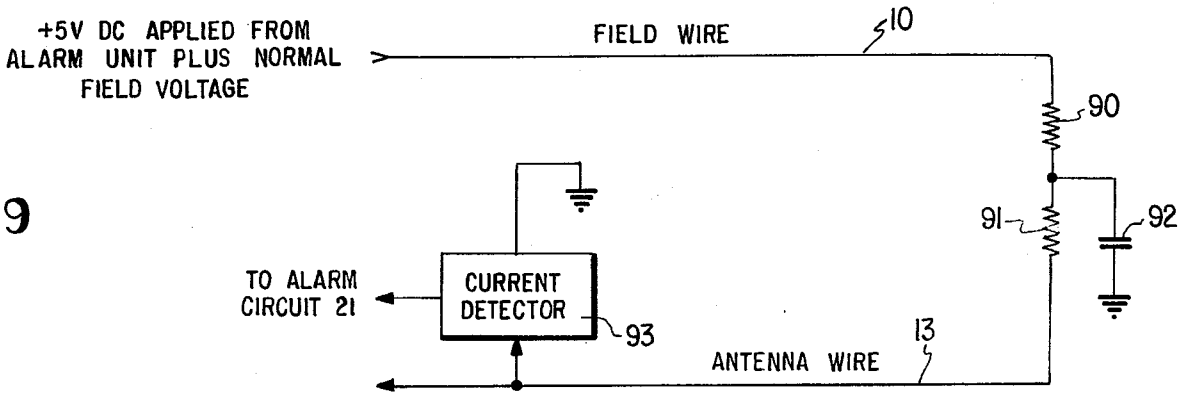
FIG. 9 is a schematic circuit diagram illustrating an arrangement according to the invention for providing supervision of the field and antenna wires for an arrangement such as shown in FIGS. 7 and 8.
Figure 10:
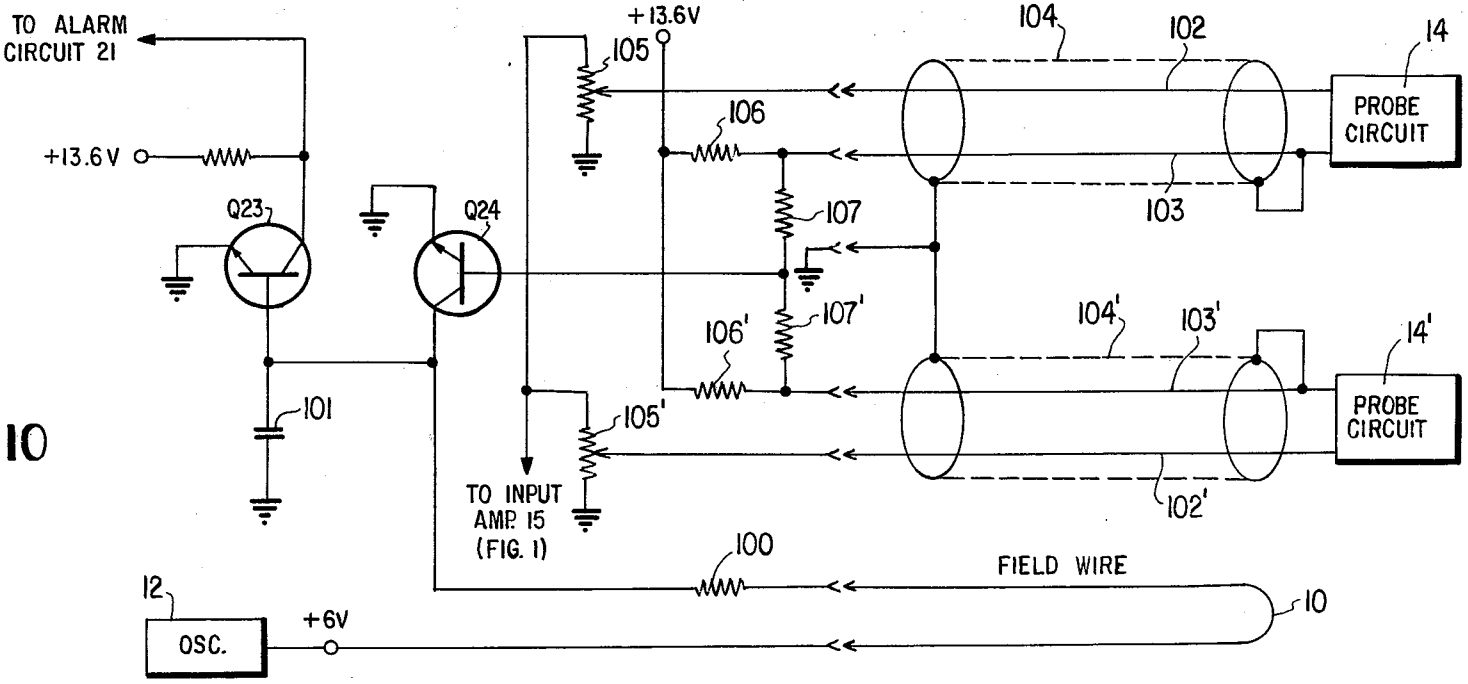
FIG. 10 is a schematic diagram of a circuit arrangement for providing supervision for the field wire and the tuned probe circuit cable for an arrangement such as shown, for example, in FIG. 6.

Although the supervision arrangement of FIG. 9 operates satisfactorily for the monitoring of an arrangement wherein a long antenna wire is utilized, a different problem exists wherein an installation such as shown for example, in FIG. 5 is present. In such an installation, it is desirable to provide supervision for the field wire and for the shielded cable connected to the remotely located tuned probe circuit and antenna arrangement. FIG. 10 shows such a supervision arrangement.

In order to supervise the field wire 10, a d.c. voltage is applied to the end of the field wire connected to the output of the oscillator 12 and the other end of the field wire 10 is connected via a resistance 100 and a capacitance 101 to ground in order to shunt the output signal from the oscillator 12 to ground. Connected to the capacitor 101 is the base of a transistor Q23 whose emitter is connected to ground and whose collector is connected to a source of d.c. voltage and to the alarm circuit 21 of FIG. 1. If the probe wire 10 is neither cut nor shorted to ground, the d.c. voltage applied thereto will appear at the base of transistor Q23 and hold same in the conducting state. However, in the event the field wire 10 is cut or grounded at some point, current wil no longer flow to the base of transistor Q23, causing transistor Q23 to be non-conductive and its collector to go positive. The positive voltage on the collector of transistor Q23 is then fed to the alarm circuit 21 of FIG. 1 to cause the production of an alarm.

In order to be able to monitor the shielded cable connecting the tuned probe circuit 14 to the input of the amplifier 15, as shown in FIG. 10 a shielded cable having two innerconductors 102, 103 and a shield 104 is utilized. The conductor 102 is connected to the high or signal output terminal of the tuned probe circuit 14 (see FIG. 5) and via a voltage divider 105 to the input of the amplifier 15. The other inner-conductor 103 of the shielded cable is connected to the low side of the tuned probe circuit 14 (see FIG. 5) and via resistor 106 to a source of d.c. voltage. The shield 104 is connected to the conductor 103 at the location of the tuned probe circuit 14 and is connected to ground only at the end thereof at the location of the amplifier. Thus, the inner-conductor 103 and the shield 104 form a closed loop extending from the location of the amplifier to the location of the tuned probe circuit and back to the location of the amplifier. Connected to the inner-conductor 104 via a resistance 107 is the base of a transistor Q24 whose emitter is connected to ground and whose collector is connected to the base of the transistor Q23. With the circuit arrangement as shown, which is illustrated for a system with two identically connected tuned probe circuits connected to the input of the amplifier 15, if the shielded cable is intact no current will flow through the base of transistor Q24 and consequently Q24 is non-conducting. Alternatively, if the shielded cable has been cut, a current will be delivered to the base of transistor Q24 causing it to become conductive and in turn switch transistor 23 to its non-conductive state to initiate an alarm.

It will be understood that the above description of the present invention is susceptible to various modifications, changes and adaptations, and the same are intended to be comprehended within the meaning and range of equivalents of the appended claims.

What is claimed is:

1. An intrusion warning system for indicating the presence of an intruder in a given area comprising in combination: means for producing a quasi-stationary electric field within said area including a field wire insulated from ground and an oscillator circuit having its output connected to said field wire, said oscillator producing an output signal having a wavelength which is very long compared to the length of said field wire and a frequency which is in the range of from 1–40KHz; a receiving antenna within said area for receiving said electric field; an amplifier; means for connecting the output of said antenna to the input of said amplifier; an AM detector means connected to the output of said amplifier for detecting changes in the received and amplified electric field signals; a lowpass filter means connected to the output of said detector for filtering out signals above 20Hz; voltage amplifying means connected to the output of said lowpass filter for amplifying the filtered detected signal, said amplifying means including bandpass filter means for passing only the low frequency component of the detected signal in the range of from 0.2 to 2Hz due to movement of an intruder in said given area; threshold circuit means connected to the output of said amplifying means for producing an output signal whenever the input signal thereto exceeds a predetermined threshold value; and means, responsive to said output signal from said threshold circuit means, for providing an alarm indicating the presence of an intruder within said given area.

2. The intrusion warning system as defined in claim 1 wherein said output signal from said oscillator has a frequency in the range of from 2–40KHz.

3. The instrusion warning system as defined in claim 1 wherein: said antenna is remotely located from said amplifier; said amplifier has a relatively low input impedance; and said means for connecting said antenna to said amplifier includes a length of shielded cable having one end connected to said input of said amplifier and extending to said remote location, and a high impedance probe circuit means having its input connected to the output of said antenna and its output connected to the other end of said shielded cable said cables impedance being matched to the input impedance of said amplifier, said probe circuit means including a resonant circuit tuned to the frequency of the output signal from said oscillator.

4. The instrusion warning system as defined in claim 3 including a plurality of said antennas each connected via a respective said probe circuit means and length of shielded cable to said low impedance input of said amplifier.

5. The intrusion warning system as defined in claim 3 wherein: said AM detector is a synchronous detector having one input connected to the output of said amplifier and its switching input connected to the output of said oscillator; and wherein said probe circuit means further includes means for shifting the phase of the signal received by the antenna by 90°.

6. The intrusion warning system as defined in claim 1 wherein: said system is to provide perimeter protection of said given area; said field wire extends along the perimeter of said given area and is mounted on and suspended between a plurality of fence posts; and wherein said receiving antenna comprises a length of wire mounted on said fence posts between said field wire and ground and extending along said perimeter substantially parallel to said field wire.

7. The intrusion warning system as defined in claim 6 further comprising spring means on said posts for maintaining said field and antenna wires under sufficient tension so that any vibration of said wires will be at a rate outside of the pass band of said amplifying means.

8. The intrusion warning system as defined in claim 6 further comprising supervision means for continuously monitoring said field and antenna wires to indicate the presence of a broken or short-circuited wire, said supervision means including: first and second series connected resistors connected between the free ends of said field and antenna wires; a capacitor connected between the common junction of said first and second resistors and ground; means for passing a d.c. current through the series connection of said field and antenna wires and said first and second resistors; means for monitoring said d.c. current and for activating said means for providing an alarm whenever the monitored d.c. current falls outside of a predetermined range.

9. The intrusion warning system as defined in claim 1 further comprising supervision means for continuously monitoring said field wire to indicate the presence of a broken or grounded field wire, said supervision means including: means for applying a d.c. voltage to one end of said field wire, and monitor switch means connected to said other end of said field wire and responsive to said d.c. voltage for energizing said alarm producing means whenever said d.c. voltage of said other end of said field wire falls below a given value.

10. An intrusion warning system as defined in claim 1 wherein the frequency of said output signal of said oscillator is approximately midway between two successive harmonics of the frequency of any a.c. power existing in the vicinity of said area.

11. An intrusion warning system for indicating the presence of an intruder in a given area comprising in combination: means for producing a quasi-stationary electric field within said area including a field wire insulated from ground and an oscillator circuit having its output connected to said field wire, said oscillator producing an output signal having a wavelength which is very long compared to the length of said field wire and a frequency which is in the range of from 1–40KHz and is approximately midway between two successive harmonics of the frequency of the a.c. power existing in the vicinity of said area; circuit means for locking said frequency of said oscillator of said electric field producing means to the frequency of said a.c. power so that said frequency of said oscillator is a fixed non-whole number multiple of said power frequency; a receiving antenna within said area for receiving said electric field; an amplifier; means for connecting the output of said antenna to the input of said amplifier; an AM detector means connected to the output of said amplifier for detecting changes in the received and amplified electric field signals; a lowpass filter means connected to the output of said detector for filtering out signals above 20Hz; voltage amplifying means connected to the output of said lowpass filter for amplifying the filtered detected signal said amplifying means including bandpass filter means for passing only the low frequency component of the detected signal due to movement of an intruder in said given area; threshold circuit means connected to the output of said amplifying means for producing an output signal whenever the input signal thereto exceeds a predetermined threshold value; and means, responsive to said output signal from said threshold circuit means, for providing an alarm indicating the presence of an intruder within said given area.

12. The intrusion warning system as defined in claim 11 wherein said locking means includes: divider means, connected to the output of said oscillator, for dividing the frequency of said output signal from said oscillator down to the nominal frequency of said a.c. power; a phase comparator for comparing the phase of the output signal from said divider means with the phase of the a.c. power line signal and for producing an error signal proportional to any phase difference; and means for adjusting the frequency of said oscillator in accordance with said error signal.

13. An intrusion warning system for indicating the presence of an intruder in a given area comprising in combination: means for producing a quasi-stationary electric field within said area including a field wire insulated from ground and an oscillator circuit having its output connected to said field wire, said oscillator producing an output signal having a wavelength which is very long compared to the length of said field wire and a frequency which is in the range of from 1-40KHz and is approximately midway between two successive harmonics of the frequency of the a.c. power existing in the vicinity of said area; said oscillator being a crystal controlled oscillator operating at a frequency which is a fixed non-whole number multiple of the nominal a.c. power frequency; a receiving antenna within said area for receiving said electric field; an amplifier; means for connecting the output of said antenna to the input of said amplifier; an AM detector means connected to the output of said amplifier for detecting changes in the received and amplified electric field signals; a lowpass filter means connected to the output of said detector for filtering out signals above 20Hz; voltage amplifying means connected to the output of said lowpass filter for amplifying the filtered detected signal said amplifying means including bandpass filter means for passing only the low frequency component of the detected signal due to movement of an intruder in said given area; threshold circuit means connected to the output of said amplifying means for producing an output signal whenever the input signal thereto exceeds a predetermined threshold value; means, responsive to said output signal from said threshold circuit means, for providing an alarm indicating the presence of an intruder within said given area; a beat frequency detector for continuously monitoring the beat frequency between the power line frequency harmonics and the frequency of said oscillator; and means responsive to the detection of a beat frequency signal below a predetermined frequency for disabling said alarm means while said beat frequency signal is below said predetermined value.

14. The intrusion warning system as defined in claim 13 wherein said predetermined frequency is slightly higher than the upper frequency limit of said bandpass filter means.

15. An intrusion warning system for indicating the presence of an intruder in a given area comprising in combination: means for producing a quasi-stationary electric field within said area including a field wire insulated from ground and an oscillator circuit having its output connected to said field wire, said oscillator producing an output signal having a wavelength which is very long compared to the length of said field wire and a frequency which is in the range of from 1–40KHz; a receiving antenna within said area for receiving said electric field; am a,plifier; means for connecting the output of said antenna to the input of said amplifier; an AM detector means connected to the output of said amplifier for detecting changes in the received and amplified electric field signals, said AM detector means being a synchronous detector having one input connected to the output of said amplifier and its switching input connected to the output of said oscillator; means for shifting the phase of the input signals to said synchronous detector by 90° relative to one another to compensate for the phase shift produced by the coupling of the signal from said field wire through space to said receiving antenna; a lowpass filter means connected to the output of said detector for filtering out signals above approximately 20Hz; high gain amplifying means connected to the output of said lowpass filter for amplifying the filtered detected signal said amplifying means including bandpass filter means for passing only the low frequency component of the detected signal in the range of from 0.2 to 2Hz due to movement of an intruder in said given area; threshold circuit means connected to the output of said amplifying means for producing an output signal whenever the input signal thereto exceeds a predetermined threshold value; and means, responsive to said output signal from said threshold circuit means, for providing an alarm indicating the presence of an intruder within said given area.

16. The intrusion warning system as defined in claim 15 wherein said phase shifting means is included in said means for connecting said antenna to said amplifier.

17. The intrusion warning system as defined in claim 15 wherein: said amplifier has a relatively low input impedance; said means for connecting said antenna to said amplifier includes a length of shielded cable having one end connected to said input of said amplifier and its other end extending to said antenna, and a high impedance probe circuit means having its input connected to the output of said antenna and its output connected to said other end of said shielded cable whose impedance is matched to the input impedance of said amplifier; said probe circuit means includes a resonant circuit tuned to the frequency of the output signal from said oscillator, and said phase shifting means; said antenna is remotely located from said amplifier and comprises a metal enclosure for said probe circuit means; and said resonant circuit means and said phase shifting means of said probe circuit means comprise an inductance having one terminal connected to said antenna and to one terminal of a capacitance whose other terminal is connected to the shield of said shielded cable, the other terminal of said inductance being connected via a series resistance to the center conductor of said shielded cable which is connected to said input of said amplifier.

18. The intrusion warning system as defined in claim 15 wherein: said amplifier has a relatively low input impedance; said means for connecting said antenna to said amplifier includes a length of shielded cable having one end connected to said input of said amplifier and its other end extending to said antenna, and a high impedance probe circuit means having its input connected to the output of said antenna and its output connected to the other end of said shielded cable whose impedance is matched to the input impedance of said amplifier; said probe circuit means includes a resonant circuit tuned to the frequency of the output signal from said oscillator, and said phase shifting means; said antenna is a long length of wire; and said resonant circuit means and said phase shifting means of said probe circuit means comprise first and second capacitors, said first capacitor having one terminal connected to the shield of said shielded cable and its other terminal connected to said antenna and to one terminal of said second capacitor, said second capacitor having its other terminal connected via an inductance and a resistance to the center conductor of said shielded cable which is connected to said low impedance signal input of said amplifier.

19. An intrusion warning system as defined in claim 15 wherein the frequency of said output signal of said oscillator is approximately midway between two successive harmonics of the frequency of any a.c. power existing in the vicinity of said area.

20. An intrusion warning system for indicating the presence of an intruder in a given area comprising in combination: means for producing a quasi-stationary electric field within said area including a field wire insulated from ground and an oscillator circuit having its output connected to said field wire, said oscillator producing an output signal having a wavelength which is very long compared to the length of said field wire and a frequency which is in the range of from 1–40KHz; a receiving antenna within said area for receiving said electric field; an amplifier; means for connecting the output of said antenna to the input of said amplifier; an AM detector means connected to the output of said amplifier for detecting changes in the received and amplified electric field signals; a lowpass filter means connected to the output of said detector for filtering out signals above 20Hz; voltage amplifying means connected to the output of said lowpass filter for amplifying the filtered detected signal said amplifying means including bandpass filter means for passing only the low frequency component of the detected signal due to movement of an intruder in said given area; threshold circuit means, comprising a pulse generator connected to the output of said amplifying means, for producing an output signal whenever the input signal thereto exceeds a predetermined threshold value; circuit means, connected in series between the output of said amplifying means and the input of said pulse generator and responsive to the output signal from said amplifying means, for producing a voltage corresponding to said threshold value whenever said amplifying means produces an output signal of a single polarity for a predetermined period of time and means, responsive to said output signal from said threshold circuit means, for providing an alarm indicating the presence of an intruder within said given area.

21. The intrusion warning system as defined in claim 20 wherein said predetermined period of time is 0.75 seconds or less.

22. The intrusion warning system as defined in claim 20 wherein said circuit means for producing a voltage corresponding to said threshold value comprises a ramp voltage generating circuit and switching circuit means, responsive to the output signal from said amplifying means, for controlling said ramp voltage generating means to cause same to produce a ramp voltage whenever said amplifying means produces an output signal and to terminate the ramp voltage whenever the output signal from said amplifying means ceases or reverses polarity.

23. The intrusion warning system as defined in claim 22 wherein said ramp voltage generating circuit includes a storage capacitor having one terminal connected to ground, and means including a source of supply voltage connected to the other terminal of said capacitor for charging same; and wherein said switching circuit means includes a normally conductive transistor having an emitter, a collector and a base and having its emitter-collector path connected in parallel with said storage capacitor for short circuiting same, and means connected to the base of said transistor for rendering said transistor non-conductive to cause said capacitor to be charged only when said output signal from said amplifying means is of a negative or a positive polarity, whereby said transistor will be conductive and discharge said capacitor whenever there is no output signal from said amplifying means or said output signal from said amplifying means passes through zero volts and changes polarity.

24. The intrusion warning system as defined in claim 22 wherein: said system is to provide perimeter protection of said given area; said field wire extends along the perimeter of said given area and is mounted on and suspended between a plurality of fence posts; and wherein said receiving antenna comprises a length of wire mounted on said fence posts between said field wire and ground and extending along said perimeter substantially parallel to said field wire.

25. The intrusion detecting system as defined in claim 24 further comprising spring means on said posts for maintaining said field and antenna wires under sufficient tension so that any vibration of said wires will be at a frequency whose period is short compared to said predetermined time period.

26. An intrusion warning system as defined in claim 20 wherein the frequency of said output signal of said oscillator is approximately midway between two successive harmonics of the frequency of any a.c. power existing in the vicinity of said area.

27. An intrusion warning system for indicating the presence of an intruder in a given area comprising in combination: means for producing a quasi-stationary electric field within said area including a field wire insulated from ground and an oscillator circuit having its output connected to said field wire, said oscillator producing an output signal having a wavelength which is very long compared to the length of said field wire and a frequency which is in the range of from 1-40KHz for receiving said electric field; an amplifier remotely located from said antenna; means for connecting the output of said antenna to the input of said amplifier including a length of shielded cable whose shield is connected to ground and whose inner conductor connects the output of said antenna to the input of said amplifier; an AM detector means connected to the output of said amplifier for detecting changes in the received and amplified electric field signals; a lowpass filter means connected to the output of said detector for filtering out signals above 20Hz; voltage amplifying means connected to the output of said lowpass filter for amplifying the filtered detected signal, said amplifying means including bandpass filter means for passing only the low frequency component of the detected signal due to movement of an intruder in said given area; threshold circuit means connected to the output of said amplifying means for producing an output signal whenever the input signal thereto exceeds a predetermined threshold value; means, responsive to said output signal from said threshold circuit means, for providing an alarm indicating the presence of an intruder within said given area; supervision means for continuously monitoring said field wire to indicate the presence of a broken or grounded field wire, said supervision means including means for applying a d.c. voltage to one end of said field wire, and monitor switch means connected to said other end of said field wire and responsive to said d.c. voltage for energizing said alarm producing means whenever said d.c. voltage of said other end of said field wire falls below a given value; and further supervision means for continuously monitoring said shielded cable to indicate the presence of a broken cable, said further supervision means including: a further inner conductor for said shielded cable, the end of said further inner conductor at said remote location being connected to said shield which is connected to ground only at the location of said amplifier; a source of d.c. voltage connected to the other end of said further inner conductor; and supervising switch means connected to said other end of said further inner conductor and responsive to a current produced by a break in said cable for actuating said monitor switch means to cause said alarm producing means to be energized.

28. An intrusion warning system as defined in claim 27 wherein the frequency of said output signal of said oscillator is approximately midway between two successive harmonics of the frequency of any a.c. power existing in the vicinity of said area.

* * * * *